US010907347B2

(12) United States Patent
Moscovitch

(10) Patent No.: US 10,907,347 B2
(45) Date of Patent: Feb. 2, 2021

(54) HINGING DRYWALL APPARATUS AND METHOD

(71) Applicant: Jerry Moscovitch, Toronto (CA)

(72) Inventor: Jerry Moscovitch, Toronto (CA)

( * ) Notice: Subject to any disclaimer, the term of this patent is extended or adjusted under 35 U.S.C. 154(b) by 0 days.

(21) Appl. No.: 16/333,337

(22) PCT Filed: Sep. 14, 2017

(86) PCT No.: PCT/CA2017/000204
§ 371 (c)(1),
(2) Date: Mar. 14, 2019

(87) PCT Pub. No.: WO2018/049505
PCT Pub. Date: Mar. 22, 2018

(65) Prior Publication Data

US 2019/0211549 A1 Jul. 11, 2019

Related U.S. Application Data

(60) Provisional application No. 62/395,161, filed on Sep. 15, 2016.

(51) Int. Cl.

| | |
|---|---|
| ***E04B 2/72*** | (2006.01) |
| ***E04C 2/32*** | (2006.01) |
| ***E04C 2/04*** | (2006.01) |
| ***E04C 2/40*** | (2006.01) |
| ***E04B 1/35*** | (2006.01) |

(52) U.S. Cl.
CPC ..... *E04B 2/723* (2013.01); *E04B 1/35* (2013.01); *E04C 2/043* (2013.01); *E04C 2/328* (2013.01); *E04C 2/405* (2013.01); *E04B 2001/3572* (2013.01); *E04B 2002/725* (2013.01)

(58) Field of Classification Search
CPC .... E04B 2/723; E04B 1/35; E04B 2001/3572; E04B 2002/725; E04C 2/328; E04C 2/043; E04C 2/405
USPC ..... 52/262
See application file for complete search history.

(56) References Cited

U.S. PATENT DOCUMENTS

| | | | |
|---|---|---|---|
| 3,312,585 | A | 4/1967 | Hamme |
| 4,000,594 | A | 1/1977 | Kirk, Jr. |
| 4,077,168 | A | 3/1978 | Smith |

(Continued)

FOREIGN PATENT DOCUMENTS

| | | | |
|---|---|---|---|
| DE | 8128252 | U1 | 5/1982 |
| DE | 10241223 | A1 | 4/2004 |

(Continued)

OTHER PUBLICATIONS

International Search Report for PCT/CA2017/000204; Date of Completion of International Search: Nov. 26, 2017.

(Continued)

*Primary Examiner* — Patrick J Maestri

(57) ABSTRACT

Described herein is a drywall apparatus including drywall liner. A first gypsum-containing segment is disposed on an internal side of the drywall liner, and a second gypsum-containing segment is disposed on the internal side of the drywall liner such that a groove exists between the first segment and the second segment. The drywall liner connects the first segment to the second segment such that the first segment and the second segment are capable of hinging about a hinge axis parallel to the groove.

11 Claims, 17 Drawing Sheets

(56) References Cited

U.S. PATENT DOCUMENTS

| | | | | |
|---|---|---|---|---|
| 4,147,004 | A | 4/1979 | Day | |
| 4,352,843 | A * | 10/1982 | Eckert | B29C 53/066 428/33 |
| 4,402,170 | A | 9/1983 | Seidner | |
| 4,486,995 | A | 12/1984 | Allen | |
| 4,704,837 | A * | 11/1987 | Menchetti | E04B 2/723 52/273 |
| 4,969,380 | A | 11/1990 | Halligan | |
| 5,285,602 | A | 2/1994 | Felton | |
| 5,644,892 | A | 7/1997 | Smythe, Jr. | |
| 6,332,296 | B1 | 12/2001 | Moscovitch | |
| 6,550,203 | B1 | 4/2003 | Little | |
| 7,254,894 | B1 | 8/2007 | Halpert | |
| 7,614,196 | B2 * | 11/2009 | McConnell | B32B 5/22 52/511 |
| 8,177,541 | B2 | 5/2012 | Fahey | |
| 8,196,364 | B2 | 6/2012 | Moscovitch | |
| 8,236,114 | B2 | 8/2012 | Gangl | |
| 9,290,931 | B2 | 3/2016 | Grace | |
| 9,719,259 | B2 * | 8/2017 | Guzman | E04F 19/0436 |
| 2001/0029718 | A1 | 10/2001 | Snyder | |
| 2005/0159057 | A1 | 7/2005 | Hauber | |
| 2008/0010907 | A1 | 1/2008 | Moench | |
| 2014/0007542 | A1 | 1/2014 | Lakoduk | |
| 2014/0290166 | A1 | 10/2014 | Bordener | |
| 2015/0197941 | A1 | 7/2015 | Urso | |
| 2019/0186128 | A1 | 6/2019 | Moscovitch | |

FOREIGN PATENT DOCUMENTS

| | | | |
|---|---|---|---|
| DE | 10 2006 002910 | A1 | 7/2007 |
| DE | 20 2010 005395 | U1 | 7/2010 |
| DE | 10 2012 217989 | A1 | 4/2012 |
| EP | 0 663 483 | A1 | 7/1995 |
| EP | 0 849 415 | A1 | 6/1998 |
| EP | 2933397 | A2 | 10/2015 |

OTHER PUBLICATIONS

Written Opinion of ISA for PCT/CA2017/000204; Date of Completion of Opinion: Dec. 11, 2017.

Screenshot taken from video at http://prefabdrywall.ca/equipment; taken on Jun. 21, 2019. Video shows PanelMax in action.

Webpages at http://pft.eu/www/en/produkte/produktprogramm/spazialmaschinen/Schneidetisch.php?st=2#open discussing PFT cutting table, with video. Downloaded Jun. 24, 2019.

Flextos Supercut XPM brochure; purchased a machine in around the year 2015.

U.S. Appl. No. 62/607,517, Dec. 19, 2017, Moscovitch.

Extended European Search Report; patent No. PCT/CA2017000204; dated Apr. 14, 2020.

* cited by examiner

HINGING DRYWALL APPARATUS AND METHOD

FIELD OF THE INVENTION

This invention relates to a drywall apparatus and method, and more particularly to a hingeable drywall apparatus and method of making same.

BACKGROUND OF THE INVENTION

Drywall or gypsum boards are used in modern construction as a fire resistant smooth cladding surface for interior walls or ceilings. A drywall board is made of gypsum material sandwiched between two sheets of drywall paper or liner. In a typical manufacturing process, drywall board is formed by mixing calcium sulphate hemihydrate (known as stucco) with water and other additives to produce a slurry, which is deposited between two parallel sheets of drywall paper that form an envelope. The envelope is extruded through an orifice. The extrusion forms a continuous ribbon, several hundred feet in length, of a gypsum slurry core that is enclosed by the two sheets of drywall paper. The parallel sheets of paper are provided from a roll that continuously unwinds to supply the board line. The two sheets of drywall paper are typically glued together near the edges of the board. The ribbon is cut into individual boards. A board kiln completes the drying process.

In the construction of buildings, drywall boards are commonly used to build interior walls and corners. The edges of drywall boards are often tapered such that where two drywall boards abut, a cove or depression is formed. The cove is first filled with joint compound and then tape is pressed into the joint compound along the full length of the cove. More joint compound is then placed over the tape before the first sanding of the resulting joint is performed. Iterations of joint compound application and sanding are performed as needed.

The area where two boards abut at a corner is often more difficult to finish than where two boards abut along a flat portion of a wall or ceiling. At an inner (less than 180 degrees) or outer (greater than 180 degrees) corner, taping, joint compound application and sanding are more cumbersome. The joint application and sanding process is usually performed several times, even by an experienced and highly skilled drywall finisher, before the corner joint takes on the appearance of a cleanly, integrally formed corner area with no visually perceptible joint areas. The finishing process is especially time consuming and highly dependent upon the skill of the drywall finisher. As will be appreciated, this adds to the overall cost of constructing any structure where drywall is used and increases the time needed for drywall finishing.

The above finishing process can be particularly troublesome for home remodelling applications undertaken by "do-it-yourself" persons who do not have extensive experience in working with drywall finishing and have not acquired the necessary skill to finish inner and outer corner areas of a structure in a manner that produces clean, well-finished corner areas free from visual imperfections. Whereas the portions of adjacent drywall boards having tapered edges that meet along a flat wall or ceiling can usually be finished adequately by even a "do-it-yourself" person, the inner and outer corner areas are usually difficult and time consuming for such persons to finish.

When forming outer corners between two drywall boards, it has previously been necessary to nail or screw a metal corner section over the corner before taping and applying joint compound to the corner. The metal corner member has to be attached carefully such that it forms a straight vertical edge. If this component is not attached properly, a "wavy", non-linear edge will be formed, requiring even further finishing efforts.

It is therefore a principal object of the present invention to provide an apparatus and method for enabling inner and outer drywall corners to be quickly and easily constructed.

It is still a further object of the present invention to provide an apparatus and method which is inexpensive to produce, easy to ship and install, and which further does not add appreciably to the overall construction costs when working with drywall boards, and which further enables the drywall finishing process to be performed with reduced labour time and skill level.

It is still another object of the present invention to provide an apparatus and method which can be readily adapted for forming either an inner corner or an outer corner area.

SUMMARY OF THE INVENTION

Described herein is a drywall apparatus including drywall liner having an external side and an internal side opposite the external side. A first gypsum-containing segment is disposed on the internal side of the drywall liner, and a second gypsum-containing segment disposed on the internal side of the drywall liner such that a groove exists between the first segment and the second segment. The drywall liner connects the first segment to the second segment such that the first segment and the second segment are capable of hinging about a hinge axis parallel to the groove. The first segment and the second segment are also capable of assuming a flat position in which the first segment and second segment are coplanar, such that when in the flat position, the drywall liner is capable of having a width at the groove that is at least 40 thousands of an inch. The drywall apparatus further includes a non-metallic strengthening material in at least part of the groove for reinforcement.

Also described herein is a method of constructing a hingeable drywall apparatus including the steps of providing finishing drywall liner having an internal side and an external side and then pouring gypsum slurry onto the internal side of the finishing drywall liner. The method also includes the steps of forming a first groove on a framing drywall liner, the first groove having an appropriate shape and placing the framing drywall liner on the gypsum slurry so that the gypsum slurry is sandwiched between the finishing drywall liner and the framing drywall liner. The method further includes allowing the gypsum slurry to set to a hardened gypsum material, wherein, during the step of allowing and before the gypsum slurry has completely set to the hardened gypsum material, the shape of the first groove is impressed upon the slurry resulting in a second groove in the hardened gypsum material that is co-linear and mates with the first groove to thereby form a hinge at the first and second grooves.

Also described herein is a drywall system including a first drywall panel and a second drywall panel connected to the first drywall panel via a main hinge. A first drywall flap connected to the first drywall panel via a first hinge, and a second drywall flap connected to the second drywall panel via a second hinge. The first drywall panel, the second drywall panel, the first drywall flap and the second drywall flap can hinge to assume at least one corner configuration in which the first and second flaps lie on a first plane, the first drywall panel lies on a second plane and the second drywall panel lies on a third plane, such that the first plane, the second plane and the third plane are mutually orthogonal.

DETAILED DESCRIPTION

Figure 1:
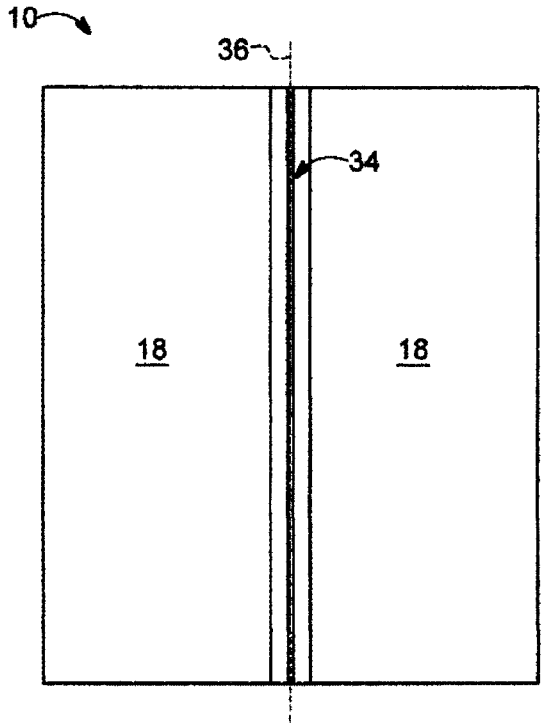
FIG. 1 shows a plan view of a drywall apparatus for forming corners in houses, buildings and the like, according to the principles of the present invention.
Figure 2A:
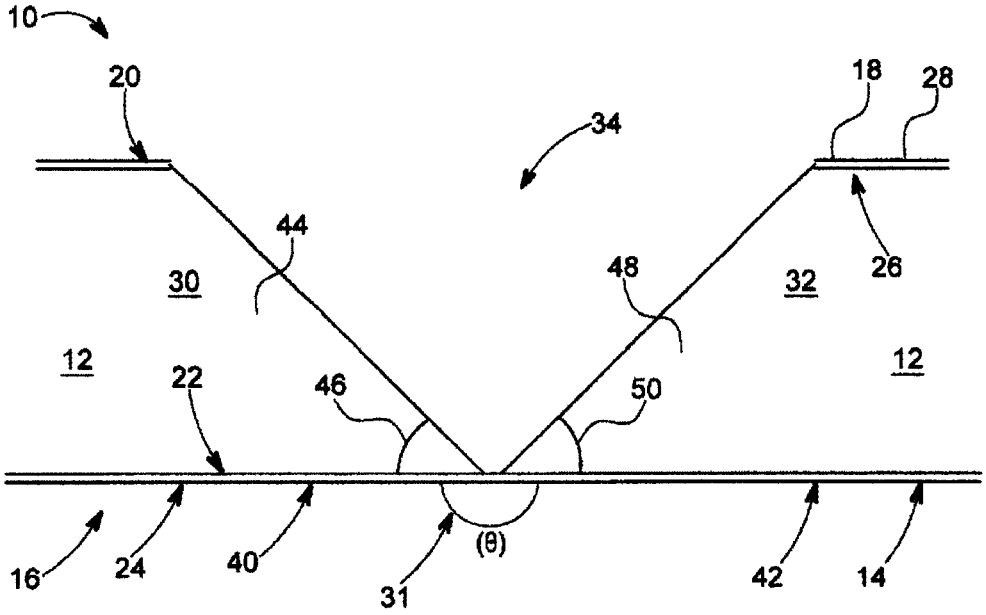
FIGS. 2A and 2B show cross sectional views of a drywall apparatus of FIG. 1.
Figure 2B:
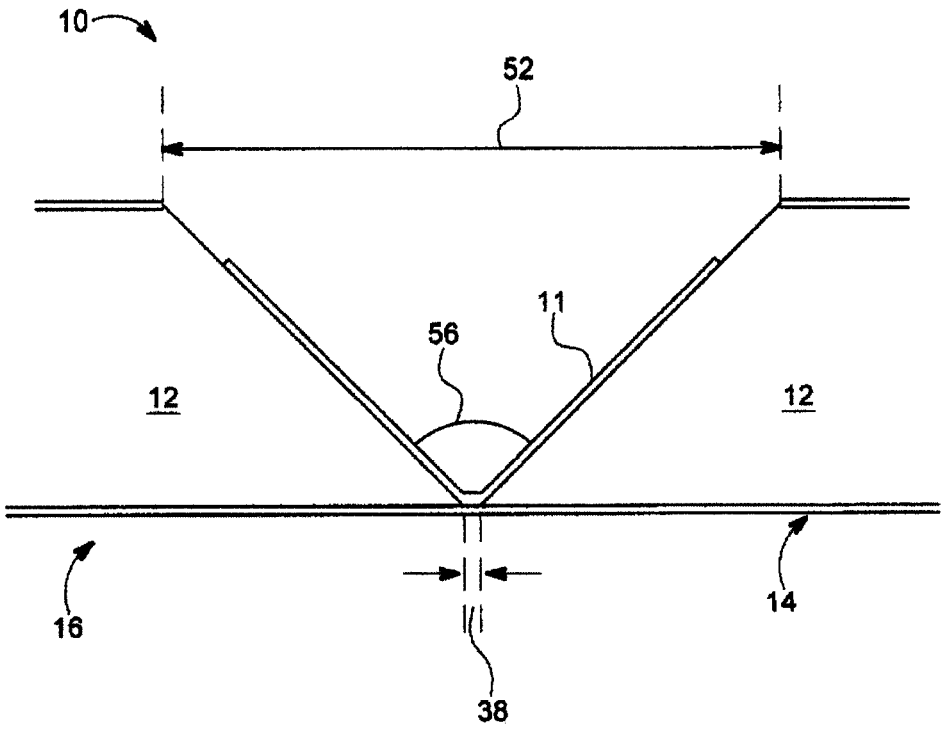

FIG. 1 shows a plan view and FIGS. 2A and 2B show a cross sectional view of a drywall apparatus 10 for forming corners in houses, buildings and the like, according to the principles of the present invention. FIG. 2A shows the drywall apparatus 10 without a strengthening material 11, and FIG. 2B shows the drywall apparatus with the strengthening material 11, as explained in more detail below. The drywall apparatus 10 includes gypsum material 12, a finishing drywall liner 14 on a finishing side 16, and a framing drywall liner 18 on a framing side 20. The finishing drywall liner 14 has an internal (or slurry) side 22, which during manufacture of the gypsum board is in contact with gypsum slurry, and an external side 24, which can be painted, wallpapered, etc. Likewise, the framing drywall liner 18 has an internal (or slurry) side 26, which during manufacture of the gypsum board is in contact with gypsum slurry, and an external side 28, which is in contact with the framing studs or joists when installed.

The external side 24 of the finishing drywall liner 14 is typically exposed to an observer inside a room. As mentioned above, the external side 24 can be finished with paint or wallpaper, for example. The external side 24 of the framing drywall liner 18 is typically unexposed to an observer inside a room. As mentioned above, the external side 28 of the framing drywall liner 18 faces and is in contact with framing structures, such as wood or metal studs or joists. Sheets of finishing drywall liner 14 may be of a different quality than sheets of framing drywall liner 18. Commercially available drywall boards typically consist of gypsum material sandwiched between a finishing drywall liner and a framing drywall liner.

The gypsum material 12 is divided by a groove 34 into two segments 30 and 32 on either side of the groove 34. The first gypsum-containing segment 30 is disposed on the internal side 22 of the finishing drywall liner 14. The second gypsum-containing segment 32 is also disposed on the internal side 22 of the finishing drywall liner 14. The groove 34 runs between the first segment 30 and the second segment 32. The finishing drywall liner 14 connects the first segment 30 to the second segment 32. A hinge axis 36 runs parallel to the groove 34.

The first segment 30 and the second segment 32 are capable of hinging about the hinge axis 36. Moreover, the first segment 30 and the second segment 32 are capable of assuming a flat position in which the first segment 30 and the second segment 32 are coplanar. The first segment 30 and the second segment 32 are shown in the flat position in FIGS. 1, 2A and 2B.

The finishing drywall liner 14 can have a maximum width 38 at the groove 34 that is at least 40 thousands of an inch when the first gypsum-containing segment 30 and the second gypsum-containing segment 32 are spread apart as much as possible without tearing the drywall liner 14. In one embodiment, such a width 38 is 52 thousands of an inch. The external side 24 of the finishing drywall liner 14 is divided by the hinge axis 36 into a first external side 40 and a second external side 42. The groove 34 is formed by forming a first edge 44 having a first edge angle 46 on the first segment 30, and a second edge 48 having a second edge angle 50 on the second segment 32. In FIGS. 2A and 2B, the first edge angle 46 and the second edge angle 50 are each 45 degrees.

In FIG. 2A, the framing drywall liner 18 is disposed to the right and left of the groove 34 but not therein. If desired, the framing drywall liner can line some of the groove. For example, framing drywall liner can span the groove intact. In one embodiment, a tear of the framing drywall liner can be formed in the groove, such as with a saw, scraper or router. The tear divides the framing drywall liner into a first portion and a second portion such that part of the first portion resides in the groove and part of the second portion resides in the groove, wherein the part of the first portion is disposed on the first gypsum-containing segment, and the part of the second portion is disposed on the second gypsum-containing segment.

Figure 2C:
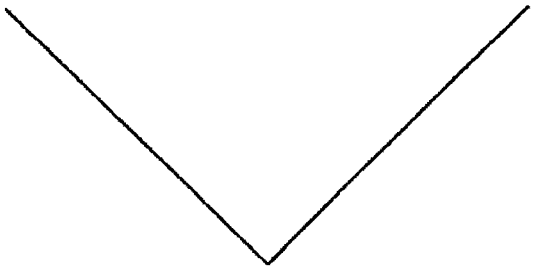
FIGS. 2C-E show various profiles of substantially V-shaped grooves, according to the principles of the present invention.
Figure 2D:
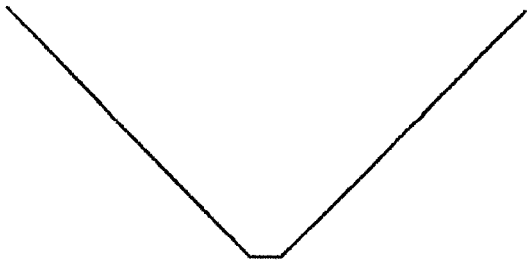
Figure 2E:
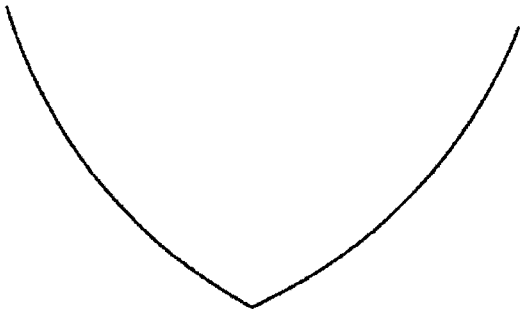

The groove 34 in FIGS. 2A and 2B is substantially V-shaped in cross section. As used herein, the term "substantially V-shaped" describes not only shapes where the two legs of the V meet at a point, but also blunted shapes in which the two legs of the "V" do not meet at a point, but instead are joined by a flat, such as in FIG. 2A. The term "substantially V-shaped" also includes shapes where the legs of the V are not perfectly straight, but bowed slightly. FIGS. 2C-E show various profiles of substantially V-shaped grooves. As explained below, strengthening material can be applied to the groove area. Advantageously, the profiles of FIGS. 2D and 2E allow room for the strengthening material and/or drywall liner to reside when the two halves of the drywall apparatus are rotated towards each other, thereby preventing bunching or buckling of strengthening material and/or drywall liner near the hinge. Such bunching or buckling could place unwanted stress on the finishing paper near the hinge resulting in tearing.

Figure 2F:
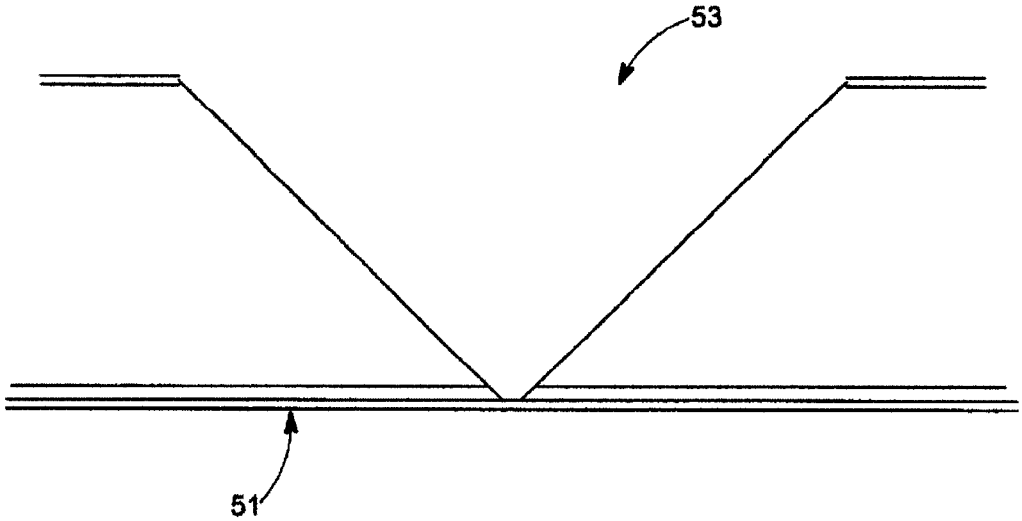
FIG. 2F shows finishing paper that is thinner along the groove, according to the principles of the present invention.

In one embodiment designed to prevent bunching or buckling, and shown in FIG. 2F, finishing paper 51 is thinner along the groove 53, such as along and near the hinge axis. For example, the finishing paper 51 could be composed of two plies of paper everywhere except in all or in part of the groove, where it could be one-ply. The one-ply paper would be less likely to bunch up than two-ply paper during hinging because there would be less paper material at the hinge axis. The width of the one-ply paper could be approximately the width of the flat at the groove or somewhat larger or smaller, for example.

In another embodiment, the finishing paper could be four-ply, except at the groove where it would be three-ply. More generally, according to the principles of the present invention, the finishing paper could be n-ply, except at the groove where it would be m-ply, where n>m.

In the embodiment shown in FIGS. 2A and 2B, the substantially V-shaped groove has a largest width 52 on the framing side 20 tapering to the narrowest width 38 at the finishing side 16. For example, the narrowest width 38 can lie in the range of 40 thousands of an inch to 60 thousands of an inch. In FIGS. 2A and 2B, showing the drywall apparatus 10 in the flat position, a cross-sectional groove angle 56 subtended by the two legs of the V is 90 degrees.

Because of the hinging action of the first and second segments, which can damage the finishing drywall liner 14 at the location of the groove 34, it is preferable to add a strengthening material 11 in the groove. With reference to FIG. 2B, the strengthening material 11, such as an elastomer, is applied on at least part of the internal side 22 of the finishing drywall liner 14 at the groove 34. The strengthening material 11 is applied for strength or reinforcement of the finishing drywall liner 14 at the groove 34. The elastomer 11 can include silicone that can be cured by heating or with light, for example. The elastomer can be sprayed on the drywall liner or gypsum. Other strengthening materials include ethylene-vinyl acetate (EVA), polyurethane and/or acrylic latex. In addition to or instead of an elastomer, a strip of paper, sheet metal or plastic can be applied running along or transverse to the groove 34 to strengthen the finishing drywall liner 14 at the groove 34. The strip of paper, sheet metal or plastic can be applied with glue, or some other appropriate fastening means. The strengthening material 11 helps prevent the drywall liner 14 connecting the first segment 30 to the second segment 32 from tearing.

In one embodiment, the strengthening material is an elastomeric coating that is applied at least on part of the internal side of the drywall liner, the elastomeric coating having no other strengthening material applied thereon.

Figure 2G:
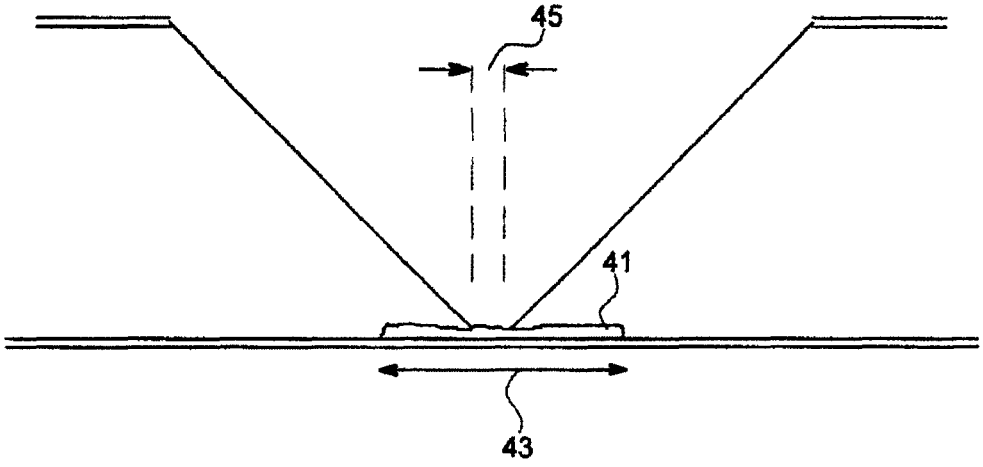
FIG. 2G shows a coating of strengthening material disposed on the internal side of a drywall liner, according to the principles of the present invention.

With reference to FIG. 2G, instead or in addition, a coating of strengthening material 41 is completely disposed on the internal side of the drywall liner. In FIG. 2G, the drywall apparatus is in the flat position, and in such position a) the coating 41 is planar, lying flat on the internal side, and b) at least part of the coating has a dimension 43, as measured perpendicular to the hinge axis (or the groove, since the hinge axis and the groove are parallel) and parallel to the drywall liner, that is larger than the width 45 at the groove. For example, the strengthening material can be applied on at least part of the internal side 22 of the finishing drywall liner 14 at the groove 34 during the manufacturing process before slurry is poured on the internal side 22. Advantageously, the strengthening material can prevent the slurry from impregnating the finishing drywall liner at the groove thereby helping to prevent the finishing liner from becoming brittle and cracking when hinged at the groove.

The drywall apparatus 10 may be used to construct outer or inner corners, in houses, buildings and the like. As used herein, an outer corner is a corner in which an angle θ 31 between the first external side 40 of the finishing drywall liner and the second external side 42 of the finishing drywall liner satisfies 180 degrees<θ<360 degrees. Typically, the angle of an outer corner is 270 degrees. As used herein, an inner corner is a corner in which the angle θ between the first external side 40 and the second external side 42 satisfies 0 degrees≤θ<180 degrees. Typically, the angle θ of an inner corner is 90 degrees. In the flat position shown in FIG. 2A, the angle θ 31 is 180 degrees. The flat position could be used to construct a flat wall. Thus, advantageously, in addition to forming corners, the drywall apparatus 10 of the present invention can be used to build flat walls.

Figure 3:
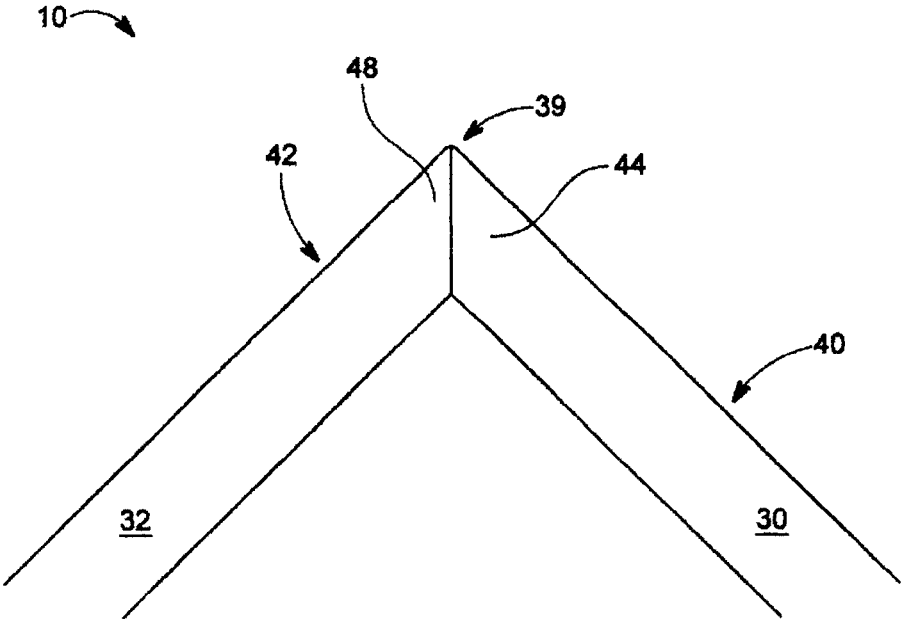
FIG. 3 shows a plan view of an outer corner position for drywall apparatus, according to the principles of the present invention.

FIG. 3 shows a plan view of an outer corner position for the drywall apparatus 10. Because of the shape of the groove 34 formed from the 45 degree first and second edge angles 46 and 50, the two segments 30 and 32 are capable of hinging about the hinge axis 36 to assume an outer corner position in which the angle between the first external side 40 and the second external side 42 of the finishing drywall liner 14 is 270 degrees. The first edge 44 and the second edge 48 abut at the groove 34 in the outer corner position. This position is suitable for forming a "square" outer corner of a room.

Advantageously, the width 38 at the groove 34 shown in FIGS. 2A and 2B is there to ensure that the elastomer 11 has a place to reside. In addition, the width 38 yields a slightly rounded corner 39 that is aesthetically pleasing when the angle between the external sides 40 and 42 is 270 degrees for forming an outer corner. The width 38 also relieves stress on the finishing drywall liner 14 so that it does not tear at the groove 34.

It will be appreciated that the appropriate groove angle is a function of the outer corner angle that one wishes to achieve. Thus, as shown in FIGS. 2A and 2B, to form an exterior angle of 270 degrees, the groove angle 56 of 90 degrees is preferably used as measured in the flat position. In another example, to form an outer corner of 300 degrees, a groove angle of 120 degrees is preferably used. In general, if the angle of the outer corner is x degrees, the groove angle as measured in the flat position is preferably the exterior angle minus 180 degrees.

Figure 4:
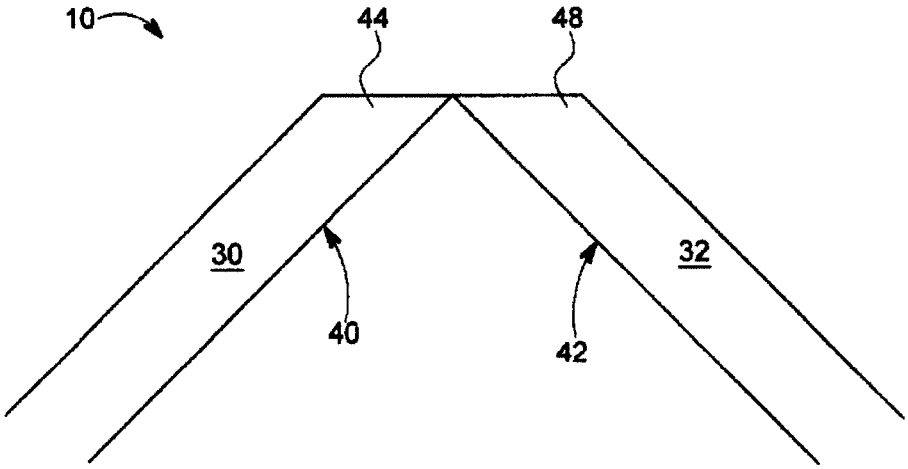
FIG. 4 shows a plan view of an inner corner position for the drywall apparatus of FIG. 1.

FIG. 4 shows a plan view of an inner corner position for the drywall apparatus of FIG. 1. The two segments 30 and 32 are capable of hinging about the hinge axis 36 to assume an inner corner position in which the angle between the first external side 40 and the second external side 42 is 90 degrees.

It will be appreciated that according to the principles of the present invention, the same drywall apparatus 10 can be used to form an outer and an inner corner.

Figure 5:
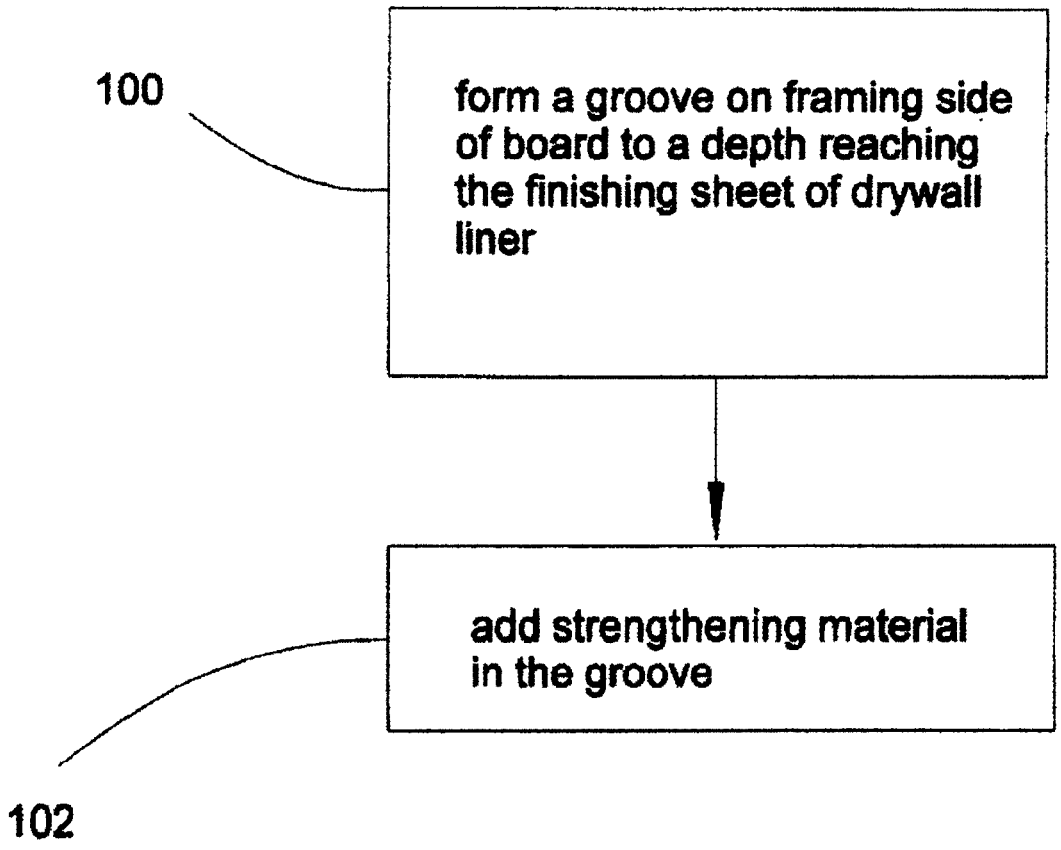
FIG. 5 lists steps for constructing a hingeable drywall board composed of gypsum material sandwiched between a finishing drywall liner and a framing drywall liner, according to the principles of the present invention.

FIG. 5 lists steps for constructing a hingeable drywall board composed of gypsum material sandwiched between a finishing drywall liner and a framing drywall liner. The finishing drywall liner may be of a different quality than the framing drywall liner. The external side of the finishing sheet is suitable for finishing the drywall exposed in a room by wallpapering or painting, for example. The framing sheet has an external side for facing and being in contact with the framing structure, such as wood or metal studs.

Step 100 includes forming a groove on the framing side of the board to a depth reaching the finishing drywall liner. The groove is substantially V-shaped in cross section, as in FIGS. 2A and 2B, with a largest width at the framing side tapering to a narrowest width at the finishing side, wherein the narrowest width is in the range of 30 thousands of an inch to 60 thousands of an inch. By forming the groove, a pliable hinge of drywall liner is created. Step 102 includes adding a strengthening material in the groove. For example, an elastomer can be applied at least on the internal side of the finishing liner at the groove. The elastomer strengthens the pliable hinge of drywall liner to prevent tearing of the drywall liner at the groove.

It should be understood that as used herein drywall board need not refer to just commercially available sizes of boards. Smaller or larger sizes are contemplated. For example, during the manufacturing process, drywall boards that are greater than several hundreds of feet are cut into commercially suitable sizes before being dried in a kiln. The steps listed above can be applied to the board before or after cutting, and before or after drying in the kiln. For example, the strengthening material can be added before or after cutting into commercially suitable sizes, and before or after drying in the kiln.

Figure 6:
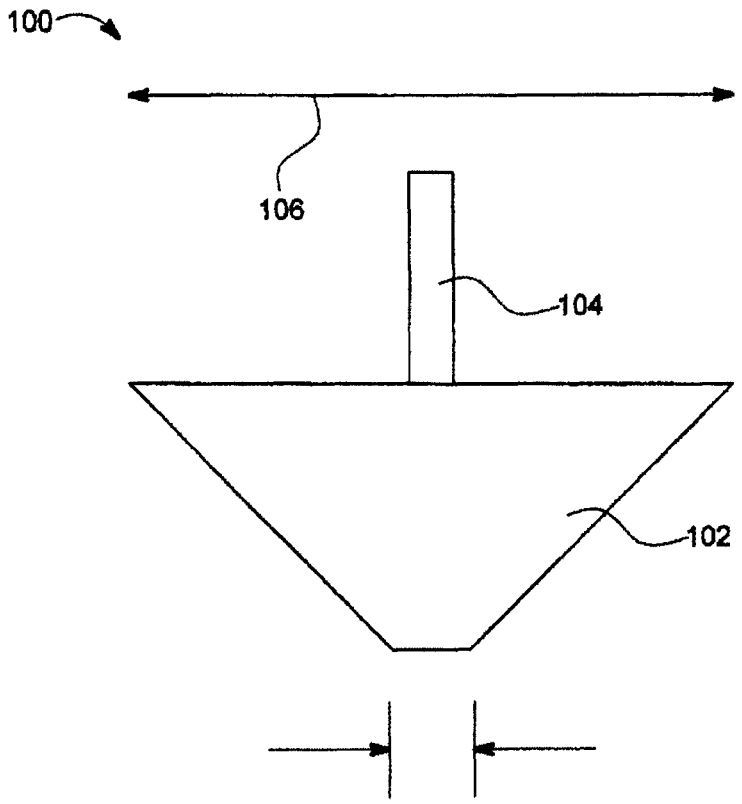
FIG. 6 shows a router for making the drywall apparatus of FIGS. 1-4.

One method for making the drywall apparatuses of FIGS. 1-4 involves a router. FIG. 6 shows such a router 100. The router 100 has a frustoconical body 102 and a stem 104. The frustoconical body 102 has a substantially V-shaped cross section with a largest width 106 tapering to a narrowest width 108. The narrowest width is in the range of 30 thousands of an inch to 60 thousands of an inch.

Some methods of producing a grooved drywall board capable of hinging may be described as subtractive processes, whereby the groove is formed by removing drywall material from a drywall board, such as by using the router 100. Instead, as will now be described, a grooved drywall board capable of hinging may be manufactured during the slurry stage by shaping to form a groove as the slurry sets to a hardened gypsum material. Advantageously, waste and gypsum dust, characteristic of a subtractive process, are avoided. In addition, this method affords the opportunity to leave the framing liner intact with or without strengthening material, in contrast to using a router which strips away the framing liner, along with some gypsum material, to form the groove. Time and expense can be saved by forming the groove during the slurry stage. In addition, certain embodiments of the drywall apparatus are best manufactured using a non-subtractive method that does not involve removing gypsum by cutting, scraping or the like. Instead, the drywall board is extruded and formed to have the desired groove that allows the board to hinge.

Figure 7A:
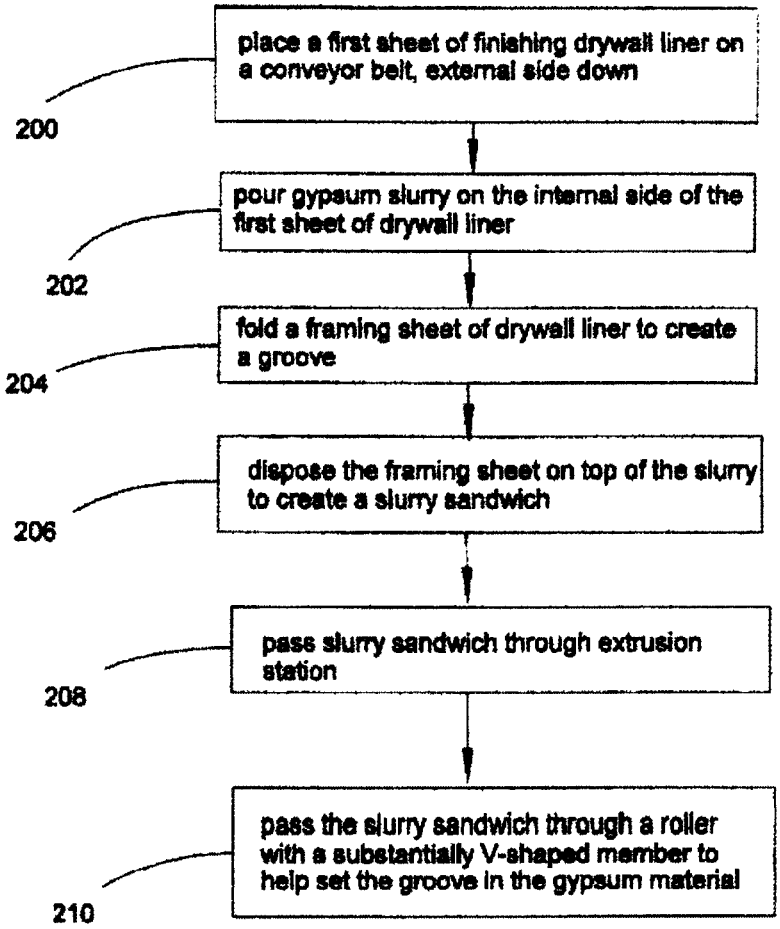
FIG. 7A shows a flow chart for making a drywall apparatus using a non-subtractive method, according to the principles of the present invention.

FIG. 7A shows a flow chart for making a drywall apparatus using a non-subtractive method, according to the principles of the present invention. In step 200, a first sheet of finishing drywall liner, having an internal side and an external side, is placed on a conveyor belt external side down. For ease of reference only, the conveyor belt will be assumed to be moving in a north direction. In step 202, gypsum slurry is poured on the internal side of the first sheet of finishing drywall liner. In step 204, which can occur before, during or after step 202, a framing drywall liner is folded to create a first groove. In step 206, the framing sheet is disposed on top of the slurry with the first groove running substantially in the north-south direction. The resultant slurry sandwich is moved by the conveyor belt to an extrusion station. In step 208, the slurry sandwich is passed through the extrusion station. Optionally, a roller, or other suitable forming guides, with a substantially V-shaped member complimentary to the first groove of the framing sheet is used at the extrusion station to help set a second groove in the gypsum material that is complimentary to the first groove of the framing sheet. After travelling past the extrusion station, in step 210 the slurry sandwich passes through another roller with a substantially V-shaped member to further help set the second groove in the gypsum material. It will be appreciated that once this setting of the gypsum material occurs, the first groove is nestled in the second groove.

Glue can be applied to the framing paper at the edges before it is placed on top of the finishing paper. The finishing paper is folded to form the edge of the drywall board. For this purpose, the finishing paper will have been pre-creased earlier in the process. Forming guides on the sides of a forming table fold the paper over to shape the edge and the extruder defines the board thickness as it travels through.

In one embodiment, inline "V-groove" equipment scores or creases three lines in the framing paper to form the V shown in FIG. 2C. The equipment extrudes this shape in the board in the board extruder. V-shaped rollers or continuous guides would also help set the V-groove. To form the substantially V-shaped groove of FIG. 2D, the equipment would score or crease four lines in the framing paper.

Figure 7B:
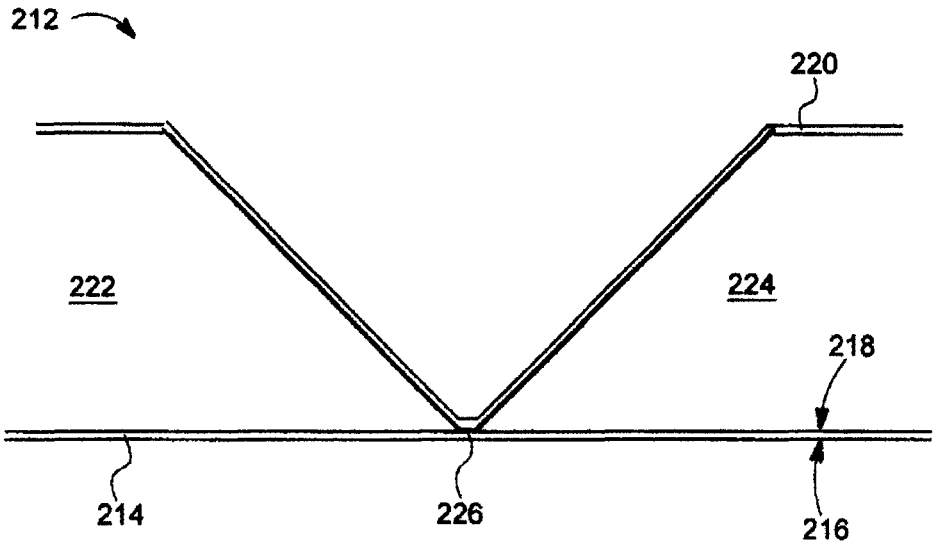
FIG. 7B shows a drywall product resulting from the method outlined in FIG. 7A.

In one embodiment, the final product of the method outlined in FIG. 7A is the drywall apparatus 212 shown in FIG. 7B. The drywall apparatus 212 includes a first sheet of drywall liner 214 having an external side 216 and an internal side 218 opposite the external side 216. The apparatus also includes a second drywall liner 220. A first gypsum-containing segment 222 resides between the first sheet 214 and the second sheet 220. A second gypsum-containing segment 224 also resides between the first sheet 214 and the second sheet 220. The first segment 222 and second segment 224 are connected by a hinge 226 formed from the first sheet 214 and the second sheet 220 to allow an angle between the first segment and the second segment to vary, such that the hinge allows the first segment and second segment to assume a flat position (shown in FIG. 7B) in which the first segment 222 and the second segment 224 are coplanar (i.e., the first sheet of drywall liner is substantially planar), wherein, in the flat position, the second sheet 220 includes a substantially V-shaped groove 228 running along the hinge 226. The groove 228 has a narrower bottom and a wider top, the bottom of the substantially V-shaped groove 228 being within 80 thousands of an inch of the internal side of the first drywall liner. The phrase "within 80 thousands of an inch" includes a preferred embodiment, shown in FIG. 7B, in which the bottom of the substantially V-shaped groove 228 is in contact with the internal side 218 of the first drywall liner 214 (i.e., the second drywall liner 220 is in contact with the first drywall liner 214).

In the embodiment shown in FIG. 7B, the second drywall liner 220 is integral along and across the groove 228. Advantageously, because the second sheet 220 remains integral, the hinge 226 is strengthened. It will be appreciated that in a subtractive process, this feature would be absent. For example, when forming a groove in a gypsum board with the router of FIG. 6, the second sheet 220 would be cut by the router along the gypsum groove, thereby removing framing paper along the groove and reducing strength in that area.

Figure 8:
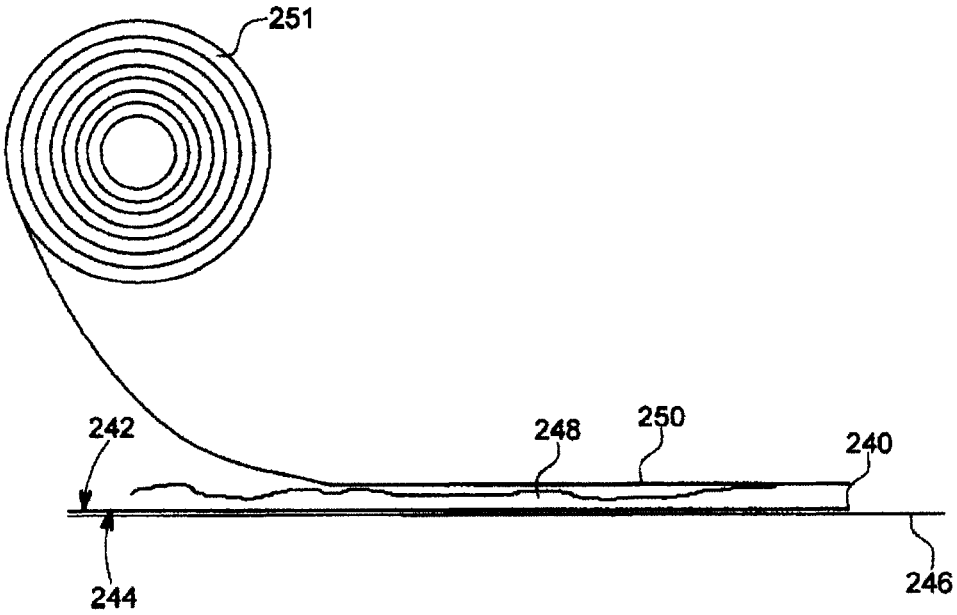
FIG. 8 shows a first finishing drywall liner placed on a conveyor belt, according to the principles of the present invention.
Figure 9A:
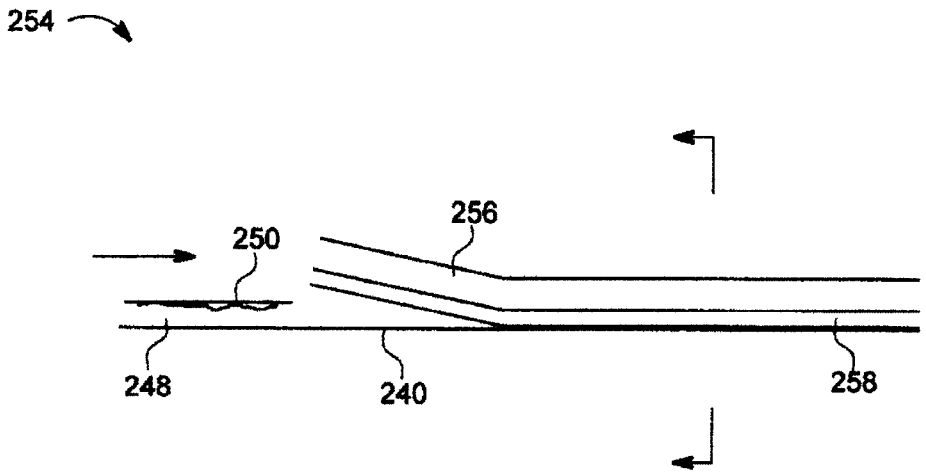
FIG. 9A shows a side view of part of an extruder station, according to the principles of the present invention.
Figure 9B:
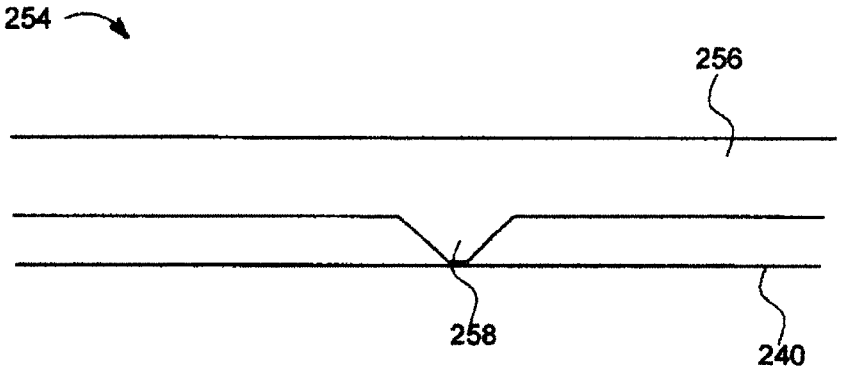
FIG. 9B shows a cross section indicated in FIG. 9A of the extruder station, according to the principles of the present invention.

FIGS. 8, 9A and 9B show some of the components involved in the non-subtractive method of making a drywall apparatus in one embodiment of the present invention.

In FIG. 8, a first sheet of finishing drywall liner 240, having an internal side 242 and an external side 244, is placed on a conveyor belt 246 external side down. Slurry 248 has been poured on the internal side 242. A framing drywall liner 250 is unspooled from a roll 251 and then disposed on top of the slurry 248 to create a slurry sandwich. In a preferred embodiment, after the framing drywall liner 250 is unspooled from the roll, but before the liner 250 meets the slurry, the liner 250 is folded at a folding station (not shown) to create the appropriate groove on the liner 250. The folding station can include a crease and/or a scoring saw for this purpose. To form the substantially V-shaped groove of FIG. 7B, for instance, four parallel, longitudinal creased or scored lines have to be produced. The inner two lines are close together to form the bottom flat of the V-shaped groove. Because of their proximity to each other, the two inner lines can be formed by one scoring saw with two adjacent blades, or one W-shaped blade. The shape of the groove will in turn help form a complementary shaped groove in the gypsum when the slurry sets further to the right in FIG. 8.

In a different embodiment, the paper on the roll 251 is already creased or scored. Pre-creasing or pre-scoring the paper obviates the need to add creasing or scoring machines to the drywall manufacturing line.

In FIG. 9A, a side view of part of an extrusion station 254 is shown. The slurry sandwich comprising slurry 248 between the finishing drywall liner 240 and the framing drywall liner 250 is passed through the extrusion station 254. The framing drywall liner 240 has been folded to create a groove (not shown) running from left to right in the FIG. 9A. An extruder member 256 with a substantially V-shaped member 258 is used at the extrusion station 254 to help set a complementary second groove in the gypsum material. The portion of the extrusion station 254 that first engages with the drywall liner 250 on top of slurry (at the left side in FIG. 9A) is slanted to guide and therefore facilitate engagement with the framing drywall liner 250. In FIG. 9B, the cross section indicated in FIG. 9A of the extruder station 254 is shown.

In one embodiment, the substantially V-shaped member 258 is as long as the distance traveled by the slurry 248 before it sets. In this manner, during the full setting process from slurry to hardened drywall, there is a force on the framing paper 250, and on the slurry beneath, to form the substantially V-shaped groove.

Figure 10:
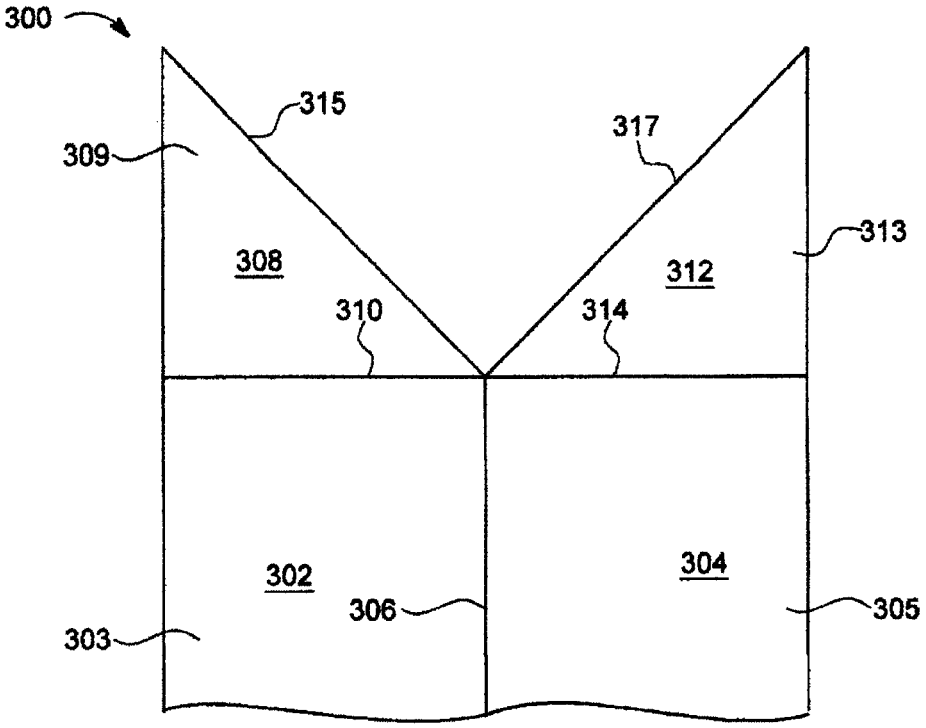
FIG. 10 shows a drywall system, according to the principles of the present invention.

FIG. 10 shows a drywall system 300 consistent with the principles of the present invention. The drywall system 300 includes a first drywall panel 302 covered with a first finishing liner 303, and a second drywall panel 304 covered with a second finishing liner 305. The first drywall panel 302 and the second drywall panel 304 are connected to each other via a main hinge 306 along a groove (not shown) that would be behind the page of the figure, like the substantially V-shaped grooves described above. The drywall system 300 also includes a first drywall flap 308 connected to the first drywall panel 302 via a first hinge 310 along a groove (not shown) that would be behind the page of the figure, like the substantially V-shaped grooves described above, and a second drywall flap 312 connected to the second drywall panel 304 via a second hinge 314 along a groove (not shown) that would be behind the page of the figure, like the substantially V-shaped grooves described above. The first drywall flap 308 is covered with a first flap finishing liner 309, and the second drywall flap 312 is covered with a second flap finishing liner 313. FIG. 10 shows the drywall system 300 in a flat configuration in which the panels 302, 304 and flaps 308, 312 are all substantially coplanar. In the embodiment shown in FIG. 10, the first flap 308 has the shape of a right angle triangle with first hypotenuse 315, and the second flap 312 has the shape of a second right angle triangle with second hypotenuse 317.

In the embodiment shown in FIG. 10, the first finishing liner 303, the second finishing liner 305, the first flap finishing liner 309 and the second flap finishing liner 313 are integral across the hinges 306, 310 and 314 (i.e., no tears across the hinges). Thus, the monikers "first" and "second" in the phrases "first finishing liner" and "second finishing liner," for example, are not meant to imply that the two liners are non-contiguous pieces with a gap therebetween. Rather, the first finishing liner 303 and the second finishing meet integrally at the hinge 306, with the hinge 306 demarcating the boundary between the first finishing liner 303 and the second finishing liner 305. Advantageously, because these finishing liners are integral at the hinges, there is no need to finish the drywall liners at the hinges with drywall tape and compound after the system is affixed to framing members to form a corner in a wall, for example.

Figure 11:
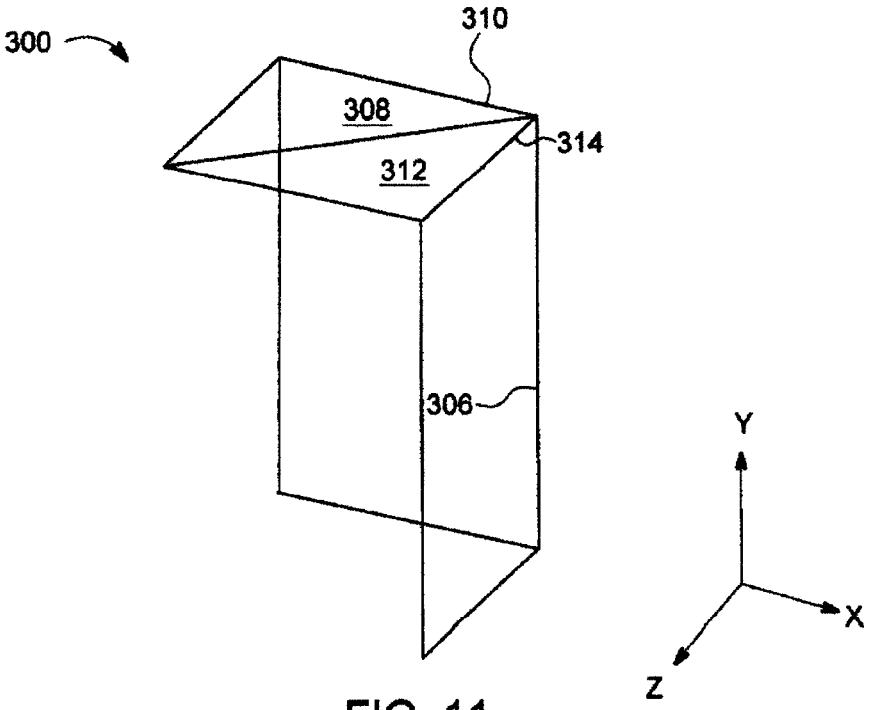
FIG. 11 shows the drywall system of FIG. 10 in an inner corner configuration, according to the principles of the present invention.

FIG. 11 shows the drywall system 300 of FIG. 10 in an inner corner position or configuration. To arrive at the inner corner configuration, the first drywall panel 302, the second drywall panel 304, the first drywall flap 308 and the second drywall flap 312 can hinge so that the first flap finishing liner 309 and the second flap finishing liner 313 lie on a first plane (parallel to the xz plane), the first finishing liner 303 lies on a second plane (parallel to the xy plane) and the second finishing liner 305 lies on a third plane (parallel to the yz plane), such that the first plane, the second plane and the third plane are mutually orthogonal. In the inner corner configuration, the angle between the first finishing liner 303 and the first flap finishing liner 309 is 90 degrees, the angle between the second finishing liner 305 and the second flap finishing liner 313 is 90 degrees, and the angle between the first finishing liner 303 and the second finishing liner 305 is 90 degrees. In the inner corner configuration, the flaps 308 and 312 also mate along their respective hypotenuses 315 and 317.

The flaps in FIG. 11, in the orientation shown, correspond to being on the ceiling. It should be understood that the drywall system can be fastened so that the flaps instead correspond to being on a wall by rotating the configuration appropriately.

Figure 12:
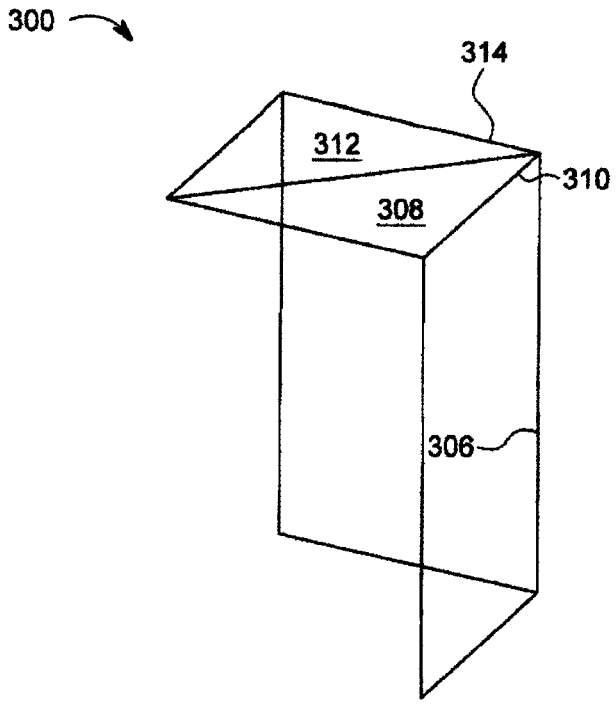
FIG. 12 shows the drywall system of FIG. 10 in one outer corner configuration, according to the principles of the present invention.

FIG. 12 shows the drywall system 300 of FIG. 10 in a first outer corner configuration. To arrive at the first outer corner configuration, the first drywall panel 302, the second drywall panel 304, the first drywall flap 308 and the second drywall flap 312 are rotated starting from the configuration shown in FIG. 10. In the first outer corner configuration, the angle between the first finishing liner 303 and the first flap finishing liner 309 is 270 degrees, the angle between the second finishing liner 305 and the second flap finishing liner 313 is 270 degrees, and the angle between the first finishing liner 303 and the second finishing liner 305 is 270 degrees. In the first outer corner configuration, the flaps 308 and 312 also mate along their respective hypotenuses 315 and 317. Again, the first flap finishing liner 309 and the second flap finishing liner 313 lie on a first plane, the first finishing liner 303 lies on a second plane and the second finishing liner 305 lies on a third plane, such that the first plane, the second plane and the third plane are mutually orthogonal. The first outer corner configuration is convenient for building certain bulkheads, for example.

Figure 13:
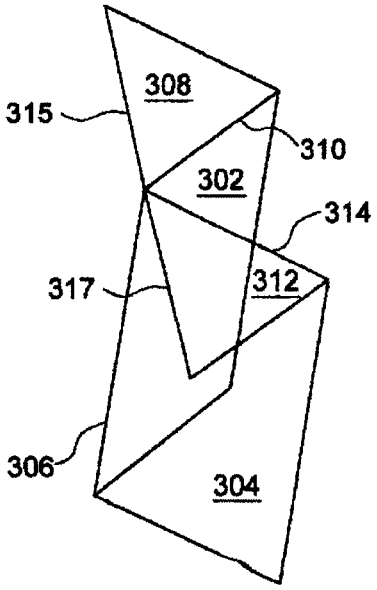
FIG. 13 shows the drywall system of FIG. 10 in another outer corner configuration, according to the principles of the present invention.

With reference to FIG. 13, there is a second outer corner configuration in which the hypotenuses 315 and 317 do not mate. In the second outer corner configuration, the angle between the first finishing liner 303 and the first flap finishing liner 309 is 90 degrees, the angle between the second finishing liner 305 and the second flap finishing liner 313 is 90 degrees, and the angle between the first finishing liner 303 and the second finishing liner 305 is 270 degrees. The second outer corner configuration is convenient for building an outer corner where two walls meet, for example.

Figure 14A:
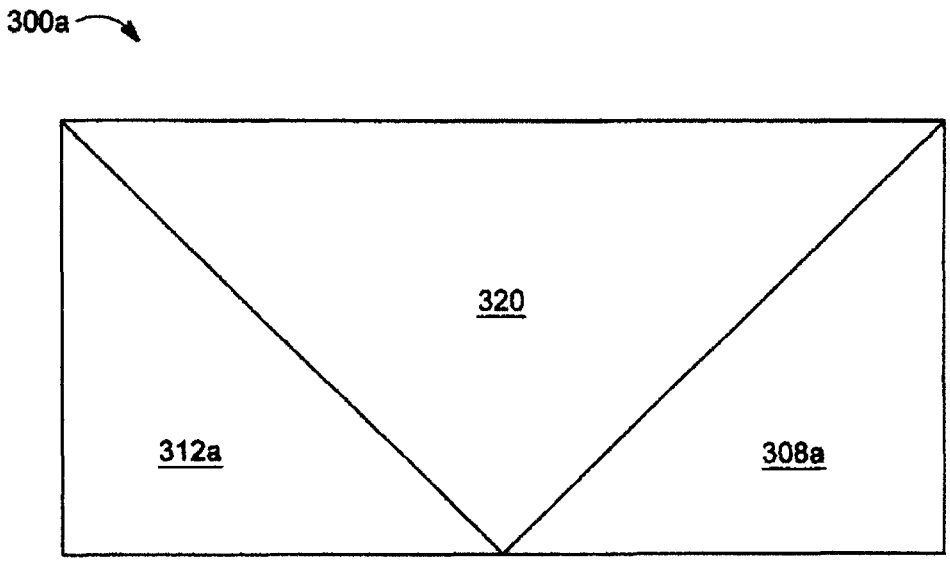
FIGS. 14A and 14B show a drywall system, similar to the drywall system of FIG. 10, in a shipping configuration, according to the principles of the present invention.
Figure 14B:
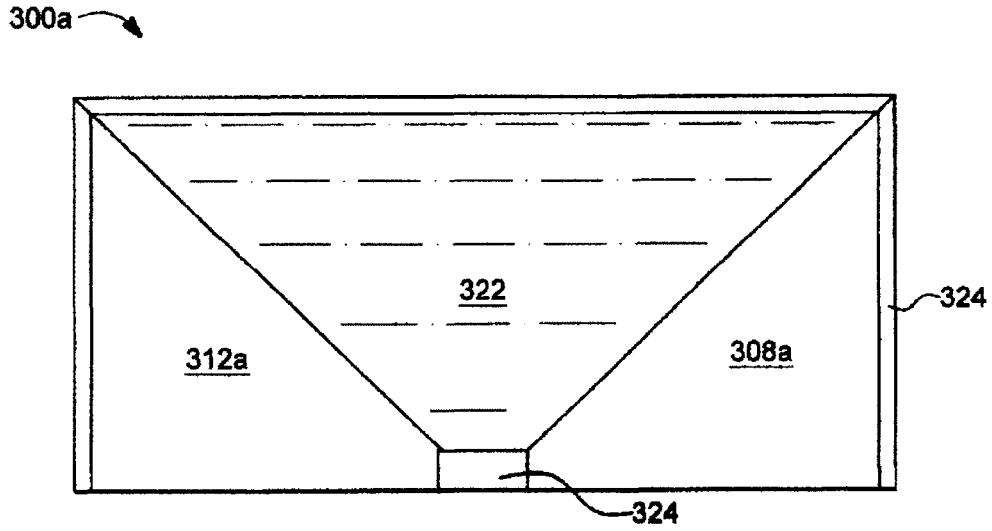

FIGS. 14A and 14B show a drywall system 300*a*, which is similar to the drywall system 300 of FIG. 10, in a shipping configuration; the drywall system 300*a* has different dimensions than the drywall system 300. In particular, the width and length of flaps 308*a* and 312*a*, corresponding to the two non-hypotenuse sides of each triangle, are of the same length, L. In other words, in plan view, each flap has the shape of an isosceles, right angle triangle with each of the two equal sides having a length L. Also, in plan view, each panel has the shape of a square with sides equal to L. FIG. 14A shows the drywall system 300*a* that has been folded into a shipping configuration, leaving a void 320. In the shipping configuration, the angle between the first finishing liner and the first flap finishing liner is zero degrees, the angle between the second finishing liner and second flap finishing liner is also zero degrees, and the angle between the first finishing drywall liner and the second finishing drywall liner is 180 degrees. In other words, in the shipping configuration, the finishing liners of the first drywall panel and the first drywall flap face and are in contact with each other; likewise, in the shipping configuration, the finishing liners of the second drywall panel and the second drywall flap face and are in contact with each other. In the shipping configuration, the first drywall panel and the second drywall panel lie flat.

FIG. 14B shows the same system 300*a* with a cardboard insert 322 filling the void to provide rigidity to the system 300*a* thereby helping to prevent tearing of the flaps 308*a* and 312*a*. To this end, tape 324 is also applied to the system 300*a* around edges. The result is a rigid system that is easy to transport and less likely to tear.

In another possible shipping configuration, consistent with the principles of the present invention, the angle between the first finishing liner and the first flap finishing liner is 180 degrees, the angle between the second finishing liner and second flap finishing liner is also 180 degrees, and the angle between the first finishing drywall liner and the second finishing drywall liner is zero degrees.

Figure 15A:
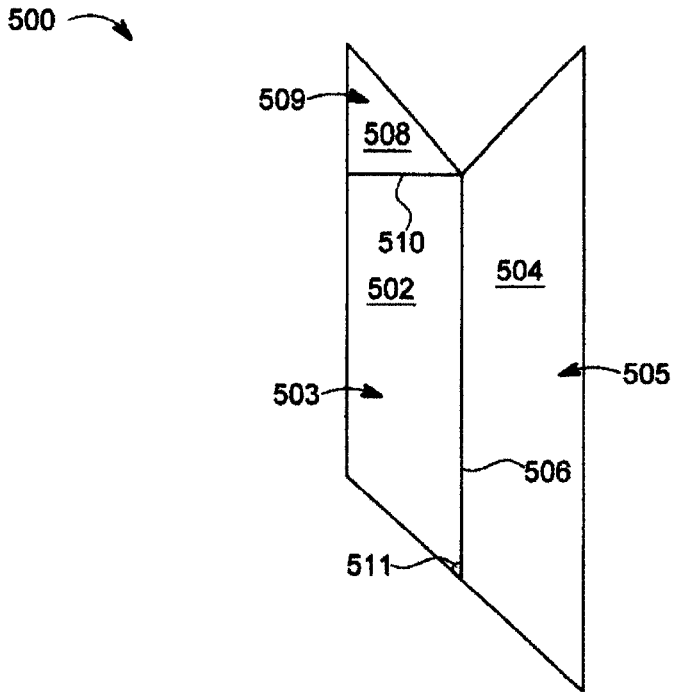
FIG. 15A shows a drywall system for framing in a flat configuration, according to the principles of the present invention.

FIG. 15A shows another drywall system 500 for framing a window, consistent with the principles of the present invention. The system 500 includes a first drywall panel 502 having a first finishing drywall liner 503, and a second drywall panel 504 having a second finishing drywall liner 505, the second drywall panel 504 connected to the first drywall panel 502 via a main hinge 506. The hinge 506 can be formed by forming a groove (not shown) on what corresponds to the back of the page of the figure. The groove can be like the substantially V-shaped grooves described above. A drywall flap 508, having a flap finishing liner 509, is connected to the first drywall panel 502 via a flap hinge 510. In the embodiment shown in FIG. 15A, the bottom of the drywall system has a forty-five degree straight cut to mate with a second drywall system to form a window frame, as detailed below.

The first drywall panel 502 and the second drywall panel 504 can hinge about the main hinge 506 so that the system can assume a window frame configuration in which the first finishing liner 503 lies on a first plane, b) the second finishing liner 505 lies on a second plane and c) the flap finishing liner 509 lies on a third plane, such that the first plane, the second plane and the third plane are mutually orthogonal. Starting from the system in the substantially flat position shown in FIG. 15, one can arrive at the window frame configuration by rotating the second drywall panel 504 ninety degrees about the main hinge 506 towards the back of the page. Next, the flap 508 is rotated, towards the front of the page, ninety degrees about the flap hinge 510. Thus, in the window frame configuration, the angle between the first finishing liner 503 and the second finishing liner 505 is 270 degrees, and the angle between the first finishing liner 503 and the flap finishing liner 509 is 90 degrees. The resultant window frame configuration is shown in FIG. 15B.

Figure 15B:
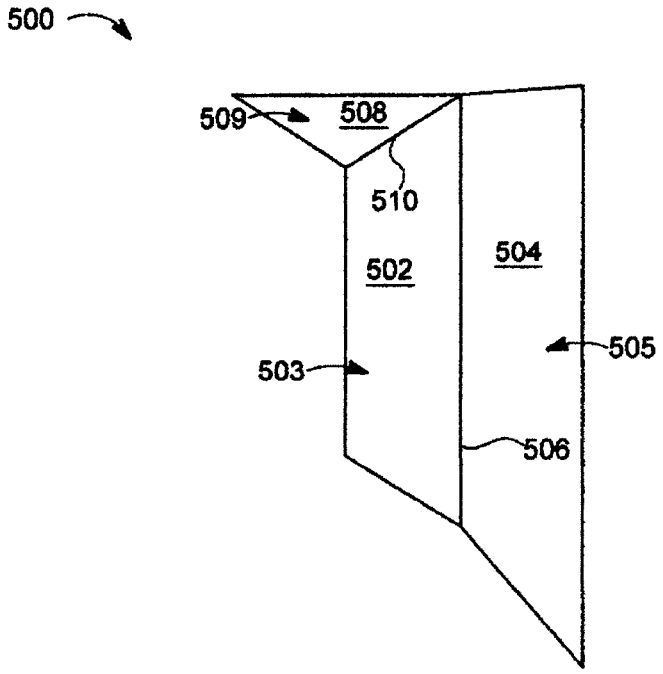
FIG. 15B shows the drywall system of FIG. 15A in a framing configuration, according to the principles of the present invention.
Figure 15C:
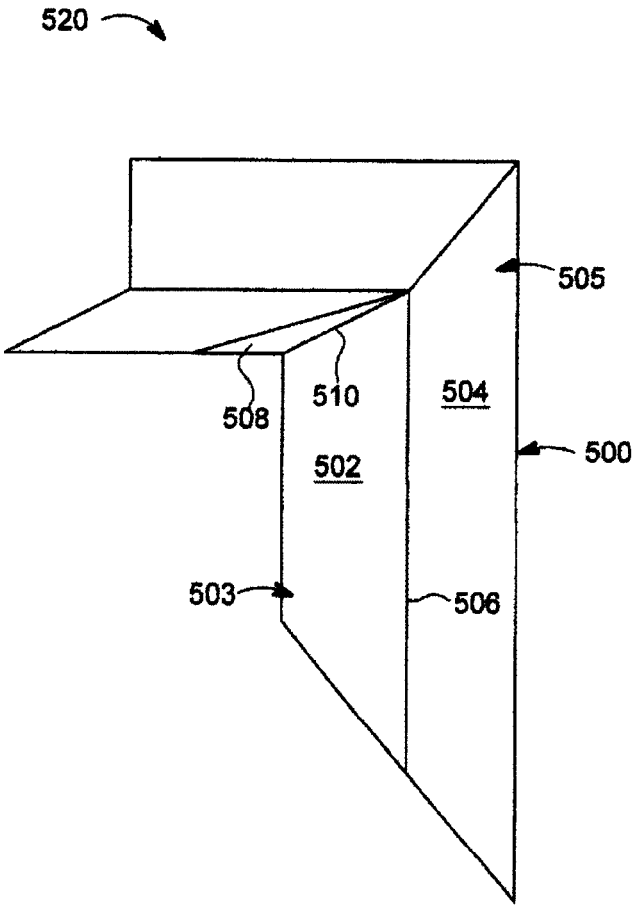
FIG. 15C shows two drywall systems, each like that shown in FIG. 15B, mated for producing a window frame, according to the principles of the present invention.

FIG. 15C shows the system 500 depicted in FIG. 15B. In addition, a similar second system 520 is also shown, also in a window frame configuration. The two systems 500 and 520 are shown mated together to form one corner of a window frame. To form a full window frame, four such systems are required to construct four corners. It will be appreciated that in the window frame configuration shown in the embodiment of FIG. 15C, the first drywall panel 502 and the flap 508 are forming an inner corner, and the first drywall panel 502 and the second drywall panel 504 are forming an outer corner, as there terms are defined above.

Advantageously, the seams formed between the two systems lie on a plane, instead of at the intersection of two planes, thus making it easier to finish the seams by taping, applying joint compound and sanding. Also advantageously, to form a square window frame, four identical systems 500 can be used, thus reducing the number of different components required to build such a frame.

The inventor contemplates several modifications to or embodiments of the system 500 shown in FIGS. 15A-C. First, as mentioned in the last paragraph, it will be appreciated that if four substantially identical systems like 500 are used, the resultant window frame will be square. For a rectangular, non-square window frame, a first pair of identical systems and a second pair of identical systems can be used, such that the second pair is longer than the first pair. In such case, a rectangular, non-square window frame will result.

Second, the system 500 makes use of forty-five degree angles. For example, the flap 508 describes an isosceles, right angled triangle, so that the angle between the hypotenuse and the hinge 510 is forty-five degrees, and correspondingly, an angle referenced as 511 in FIG. 15A is also forty-five degrees. It will be appreciated that other angles can be used. For example, the aforementioned angle between the hypotenuse and the hinge 510 can be larger than forty-five degrees provided the angle 511 is correspondingly smaller than forty-five degrees (or vice versa) so that two systems can mate to form a window frame when in the window frame configuration. Specifically, the sum of these two angles should be ninety degrees. Same considerations apply to the angles on the other panel 504. In principle, the angle 511 can approach ninety-degrees, but if ninety degrees is used (implying that the angle between the hypotenuse and the hinge 510 is zero degrees), it will be appreciated that the seam formed between the two systems will lie at the intersection of two planes, which is less desirable.

Third, the system 500 can be modified to produce two different corner systems, which together with a hinging rectangular system similar to the one shown in FIG. 1, can be used to build a window frame. Specifically, with reference to the orientation of system 500 shown in FIG. 15A, one of the two different corner systems would be obtained from system 500 by cutting a bottom portion of the system 500 to leave a horizontal bottom edge (i.e., an edge perpendicular to the left and right sides of the system 500 shown in FIG. 15A); the other one of the two different corner systems would be obtained from system 500 by cutting a top portion of the system 500 shown in FIG. 15A to leave a horizontal top edge (i.e., perpendicular to the left and right sides of the system 500 shown in FIG. 15A). Corners of the frame can be constructed by mating two such different corner systems. Middle (non-corner) sections of the frame can be constructed from a system similar to FIG. 1 by abutting an end to the aforementioned edges.

Figure 16A:
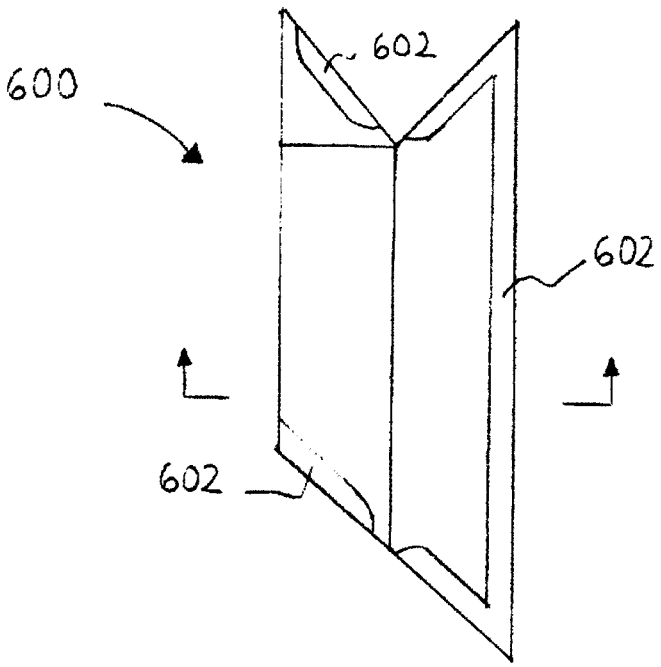
FIGS. 16A and 16B show another drywall system for framing, according to the principles of the present invention.
Figure 16B:
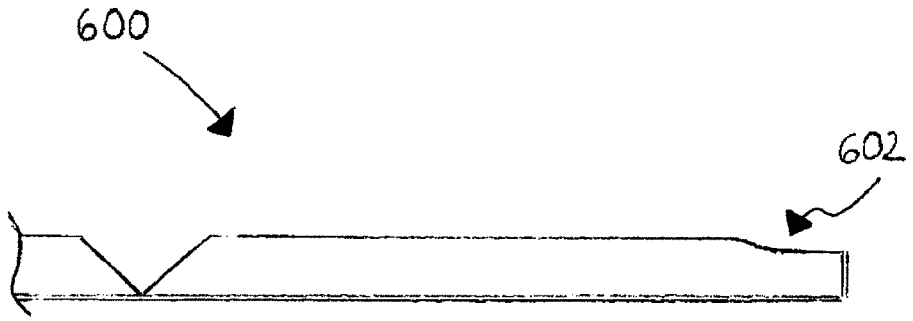

In some of the embodiments described above, a cove or depression may be added near edges that form seams. The term "seam" refers to a region where two drywall boards abut. Seams typically have to be finished by adding drywall tape and compound, followed by sanding. The cove or depression helps in this finishing process by acting as a reservoir for the compound. For example, in FIG. 16A, a drywall system 600 is shown for forming a window frame. The drywall system 600 is similar to the drywall system 500, except that depressions 602 are shown along what will form seams when abutted to other drywall systems. FIG. 16B shows a cross-sectional view as indicated in FIG. 16A, which is similar to the cross-sectional view of FIG. 2A. In other systems, these depressions are useful on the finishing side along any seam that will need finishing, such as along the hypotenuse 315 and hypotenuse 317 of the system 300 shown in FIG. 10.

Figure 17A:
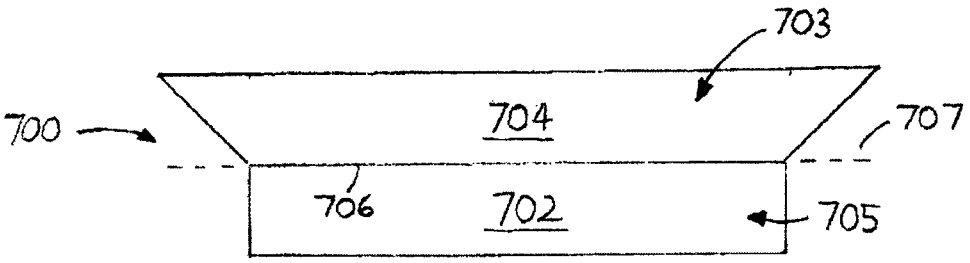
FIGS. 17A and 17B show another drywall system for framing, according to the principles of the present invention.
Figure 17B:
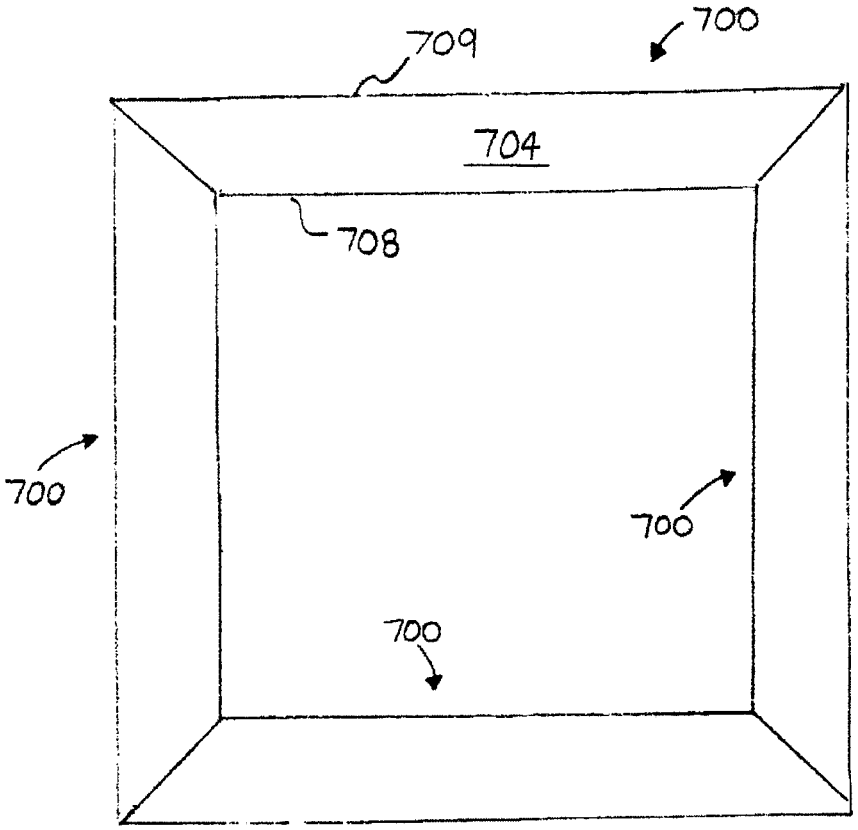

FIGS. 17A and 17B show another drywall system 700 suitable for framing, such as window framing. Several of the features of the drywall system 700 are similar to the drywall system 500 of FIG. 15A, but one difference is that the drywall system 700 has no flap. The drywall system 700 includes a first drywall panel 702 having a first finishing drywall liner 703. The first drywall panel 702 is hingeably connected to a second drywall panel 704 having a second finishing drywall liner 705. The first drywall panel 702 and the second drywall panel 704 are connected at a hinge 706, and are capable of hinging about a hinge axis 707. As mentioned above with respect to FIG. 10, the monikers "first finishing drywall liner" and "second finishing drywall liner" denote two regions continuously connected across their boundary (the hinge 706), similar to FIG. 2A or 2B. On the opposite side than the one shown in FIG. 17A, there is a groove (not shown) like that appearing in FIG. 2A or B, which will not be described here again. The groove permits the first drywall panel and the second drywall panel to assume an angle therebetween greater than 180 degrees, where, again, the angle (corresponding to θ in FIG. 2A) is measured between the first finishing drywall liner 703 and the second finishing drywall liner 705 on the side of the liners not containing gypsum material.

As shown in FIGS. 17A and 17B, the second drywall panel 704 describes a trapezoid with only two sides 708, 709 parallel. By hinging the system 700 so that the angle between the first drywall panel 702 and the second drywall panel 704 is 270 degrees ("frame configuration"), a window frame can be constructed, as shown in Figure It should be understood that in the following method claims, the order in which the steps are listed need not correspond to the temporal order in which the steps are taken in practice. In particular, in the method of constructing a hingeable drywall apparatus, the step of forming a first groove on a framing drywall liner may be performed after the step of placing the framing drywall liner on the gypsum slurry. For example, the first groove on the framing drywall liner may be formed at the same time that the shape of the first groove is impressed upon the slurry, resulting in the second groove in the hardened gypsum material.

What is claimed is:

1. A drywall system comprising:

a first drywall panel having a first finishing drywall liner;

a second drywall panel having a second finishing drywall liner, the second drywall panel connected to the first drywall panel via a main hinge;

a first drywall flap having a first flap finishing drywall liner, the first drywall flap connected to the first drywall panel via a first hinge; and a second drywall flap having a second flap finishing drywall liner, the second drywall flap connected to the second drywall panel via a second hinge, wherein the first drywall panel, the second drywall panel, the first drywall flap and the second drywall flap can hinge to assume at least one corner configuration in which at least a portion of the first flap finishing drywall liner and at least a portion of the second flap finishing drywall liner lie on a first plane, at least a portion of the first finishing drywall liner lies on a second plane and at least a portion of the second finishing drywall liner lies on a third plane, such that the first plane, the second plane and the third plane are mutually orthogonal.

2. The drywall system of claim 1, wherein the at least one corner configuration includes an inner corner configuration and an outer corner configuration, such that in the inner corner configuration, the first flap and the second flap mate, and the at least a portion of the first flap finishing drywall liner and the at least a portion of the second flap finishing drywall liner lie on the first plane.

3. The drywall system of claim 2, wherein, in the inner corner configuration, an angle between the at least a portion of the first finishing drywall liner and the at least A portionof the second finishing drywall liner is 90 degrees.

4. The drywall system of claim 2, wherein, in the outer corner configuration, an angle between the at least a portion of the first finishing drywall liner and the at least a portion of the second finishing drywall liner is 270 degrees.

5. The drywall system of claim 1, wherein the first drywall panel, the second drywall panel, the first drywall flap and the second drywall flap can hinge to assume a shipping configuration in which a) an angle between the at least a portion of the first flap finishing drywall liner and the at least a portion of the first finishing drywall liner is zero degrees, b) an angle between the at least a portion of the second flap finishing drywall liner and the at least a portion of the second finishing drywall liner is zero degrees, and c) an angle between the at least a portion of the first finishing drywall liner and the at least a portion of the second finishing drywall liner is 180 degrees.

6. The drywall system of claim 1, wherein the first drywall panel, the second drywall panel, the first drywall flap and the second drywall flap can hinge to assume a shipping configuration in which a) an angle between the at least a portion of the first flap finishing drywall liner and the at least a portion of the first finishing drywall liner is 180 degrees, b) an angle between the at least a portion of the second flap finishing drywall liner and the at least a portion of the second finishing drywall liner is 180 degrees, and c) an angle between the at least a portion of the first finishing drywall liner and the at least a portion of the second finishing drywall liner is zero degrees.

7. A method for forming a corner, the method comprising:

providing a drywall system having a first drywall panel hingeably connected to a first drywall flap via a first hinge, and a second drywall panel hingeably connected to a second drywall flap via a second hinge, wherein the first drywall flap is adapted to hinge about the first hinge and the second drywall flap is adapted to hinge about the second hinge independently of each other, and wherein the first drywall panel is hingeably connected to the second drywall panel via a main hinge, such that the first hinge and the main hinge are perpendicular; and affixing the drywall system to framing members to form a corner.

8. The A drywall system for framing comprising:

a first drywall panel having a first finishing liner;

a second drywall panel having a second finishing liner, the second drywall panel connected to the first drywall panel via a main hinge; and a drywall flap having a flap finishing liner, the drywall flap connected to the first drywall panel via a flap hinge, wherein the first drywall panel and the second drywall panel are capable of hinging about the main hinge so that the system can assume a frame configuration in which at least a portion of the first finishing liner lies on a first plane, at least a portion of the second finishing liner lies on a second plane and at least a portion of the flap finishing liner lies on a third plane, such that the first plane, the second plane and the third plane are mutually orthogonal, wherein the drywall flap describes an isosceles right-angled triangle.

9. The drywall system of claim 8, wherein the drywall flap is disposed at one end of the first drywall panel, and an opposite end of the first drywall panel has a complimentary edge such that an angle between the edge and main hinge is forty-five degrees when the system is in the flat configuration.

10. A method for forming a frame, the method comprising:

providing a drywall system having a first drywall panel, the first drywall panel being hingeably connected to a second drywall panel via a main hinge and the first drywall panel being hingeably connected to a drywall flap via a flap hinge, such that the main hinge and the flap hinge are perpendicular; and affixing the drywall system to framing members to form an angle between a finishing side of the first drywall panel and a finishing side of the drywall flap that is less than 180 degrees, and to form an angle between the finishing side of the first drywall panel and a finishing side of the second drywall panel that is greater than 180 degrees.

11. A drywall system for framing comprising: a first drywall panel; and a second drywall panel hingeablv connected to the first drywall panel along a hinge, wherein the second drywall panel describes a trapezoid with four sides, only two of the four sides being parallel, said four sides being i) a first side located at and parallel to the hinge, ii) a second side parallel to and opposite the first side, iii) a third side and iv) a fourth side opposite but not parallel to the third side, such that the first side is shorter than the second side.

* * * * *